US012139302B2

(12) United States Patent
Franklin

(10) Patent No.: US 12,139,302 B2
(45) Date of Patent: Nov. 12, 2024

(54) LAUNDRY BASKET

(71) Applicant: Antione Franklin, Hayward, CA (US)

(72) Inventor: Antione Franklin, Hayward, CA (US)

( * ) Notice: Subject to any disclaimer, the term of this patent is extended or adjusted under 35 U.S.C. 154(b) by 161 days.

(21) Appl. No.: 17/735,210

(22) Filed: May 3, 2022

(65) Prior Publication Data

US 2023/0356884 A1 Nov. 9, 2023

(51) Int. Cl.

| | |
|---|---|
| ***B65D 21/02*** | (2006.01) |
| ***B65D 25/28*** | (2006.01) |
| ***B65D 25/40*** | (2006.01) |
| ***B65D 81/26*** | (2006.01) |
| ***D06F 95/00*** | (2006.01) |

(52) U.S. Cl.

CPC ..... *B65D 21/0237* (2013.01); *B65D 25/282* (2013.01); *B65D 25/40* (2013.01); *B65D 81/263* (2013.01); *D06F 95/002* (2013.01)

(58) Field of Classification Search

CPC .. B65D 21/0237; B65D 25/282; B65D 25/40; B65D 81/263; D06F 95/002

See application file for complete search history.

(56) References Cited

U.S. PATENT DOCUMENTS 4,765,472 A * 8/1988 Dent ..... A47J 47/18 206/373
4,981,232 A * 1/1991 Wynn ..... D06F 95/002 220/532
5,429,265 A * 7/1995 Maire ..... B25H 3/00 206/372
5,575,219 A * 11/1996 Herring ..... D06F 53/005 105/151
6,321,929 B1 * 11/2001 Weshler ..... B65D 25/2835 206/217
2005/0284867 A1 * 12/2005 Sander ..... A45C 11/00 220/23.86
2014/0061236 A1 * 3/2014 Dey ..... B65D 81/3205 222/129
2016/0121916 A1 * 5/2016 Kassab Arabo ..... B62B 3/025 280/37
2019/0316290 A1 * 10/2019 Denha ..... D06F 95/002

* cited by examiner

*Primary Examiner* — Vishal Pancholi
(74) *Attorney, Agent, or Firm* — Kyle A. Fletcher, Esq.

(57) ABSTRACT

The improved laundry basket comprises a laundry basket and a plurality of product containers. The laundry basket may be operable to carry laundry to and/or from a laundry area. The plurality of product containers may detachably couple to the laundry basket. Each of the plurality of product containers may hold a laundry product. As non-limiting examples, the laundry product may be a liquid product, a granular product, or a powdered product. The plurality of product containers may fit into a plurality of container recesses that may be exposed on the exterior of the laundry basket. Each of the plurality of product containers may be held in place by a positioning clip. As non-limiting examples, the laundry products may be detergents, bleaches, fabric softeners, stain removers, and sanitizers.

19 Claims, 14 Drawing Sheets

LAUNDRY BASKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of laundry accessories, more specifically, an improved laundry basket.

SUMMARY OF INVENTION

The improved laundry basket comprises a laundry basket and a plurality of product containers. The laundry basket may be operable to carry laundry to and/or from a laundry area. The plurality of product containers may detachably couple to the laundry basket. Each of the plurality of product containers may hold a laundry product. As non-limiting examples, the laundry product may be a liquid product, a granular product, or a powdered product. The plurality of product containers may fit into a plurality of container recesses that may be exposed on the exterior of the laundry basket. Each of the plurality of product containers may be held in place by a positioning clip. As non-limiting examples, the laundry products may be detergents, bleaches, fabric softeners, stain removers, and sanitizers.

An object of the invention is to provide a laundry basket for carrying laundry.

Another object of the invention is to provide a plurality of product containers.

A further object of the invention is to detachably couple the plurality of product containers to a plurality of container recesses of the laundry basket.

Yet another object of the invention is to provide product containers that are liquid dispensing containers comprising a spigot.

These together with additional objects, features and advantages of the improved laundry basket will be readily apparent to those of ordinary skill in the art upon reading the following detailed description of the presently preferred, but nonetheless illustrative, embodiments when taken in conjunction with the accompanying drawings.

In this respect, before explaining the current embodiments of the improved laundry basket in detail, it is to be understood that the improved laundry basket is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved laundry basket.

It is therefore important that the claims be regarded as including such equivalent construction insofar as they do not depart from the spirit and scope of the improved laundry basket. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
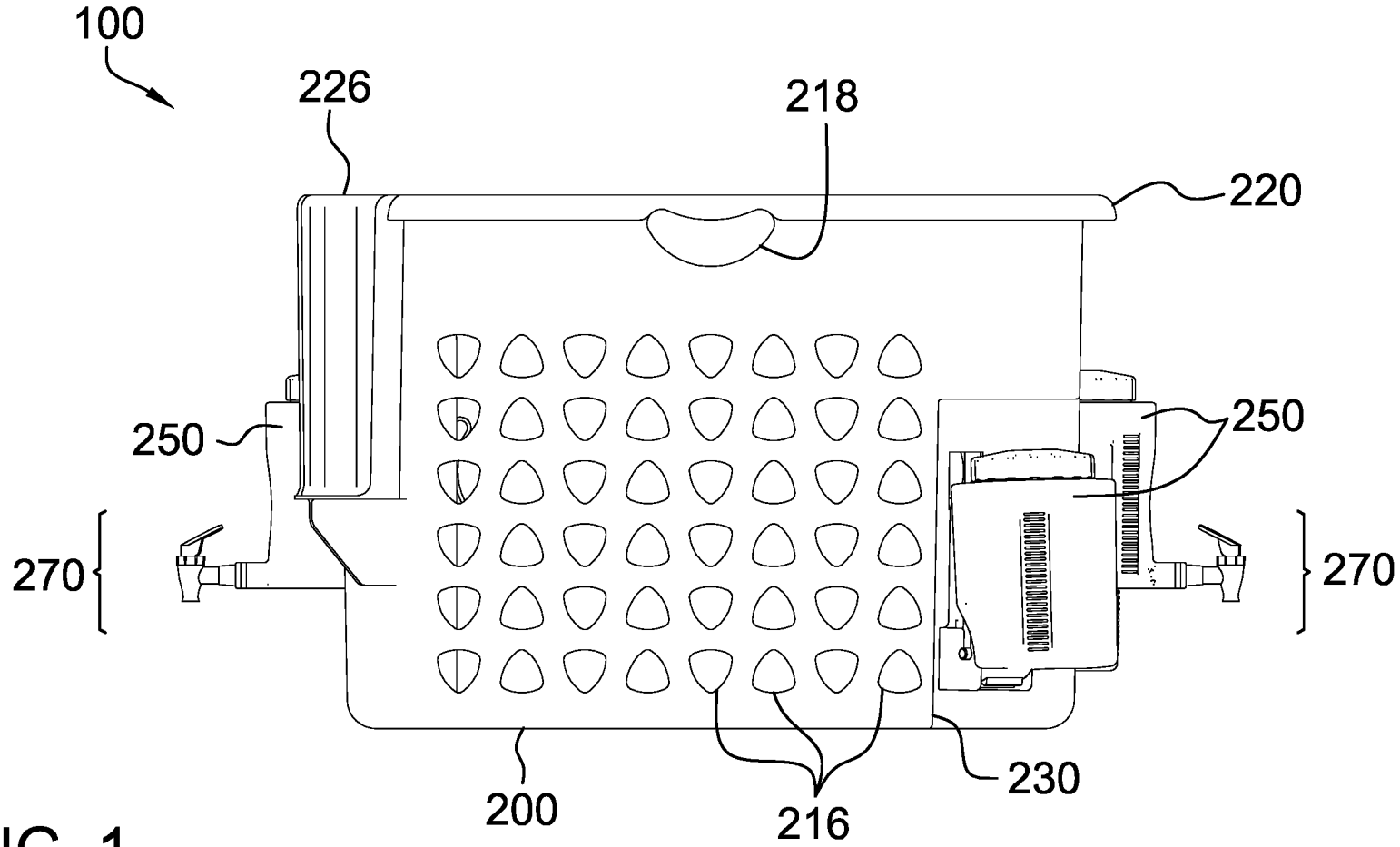
FIG. 1 is a left side view of an embodiment of the disclosure.
Figure 2:
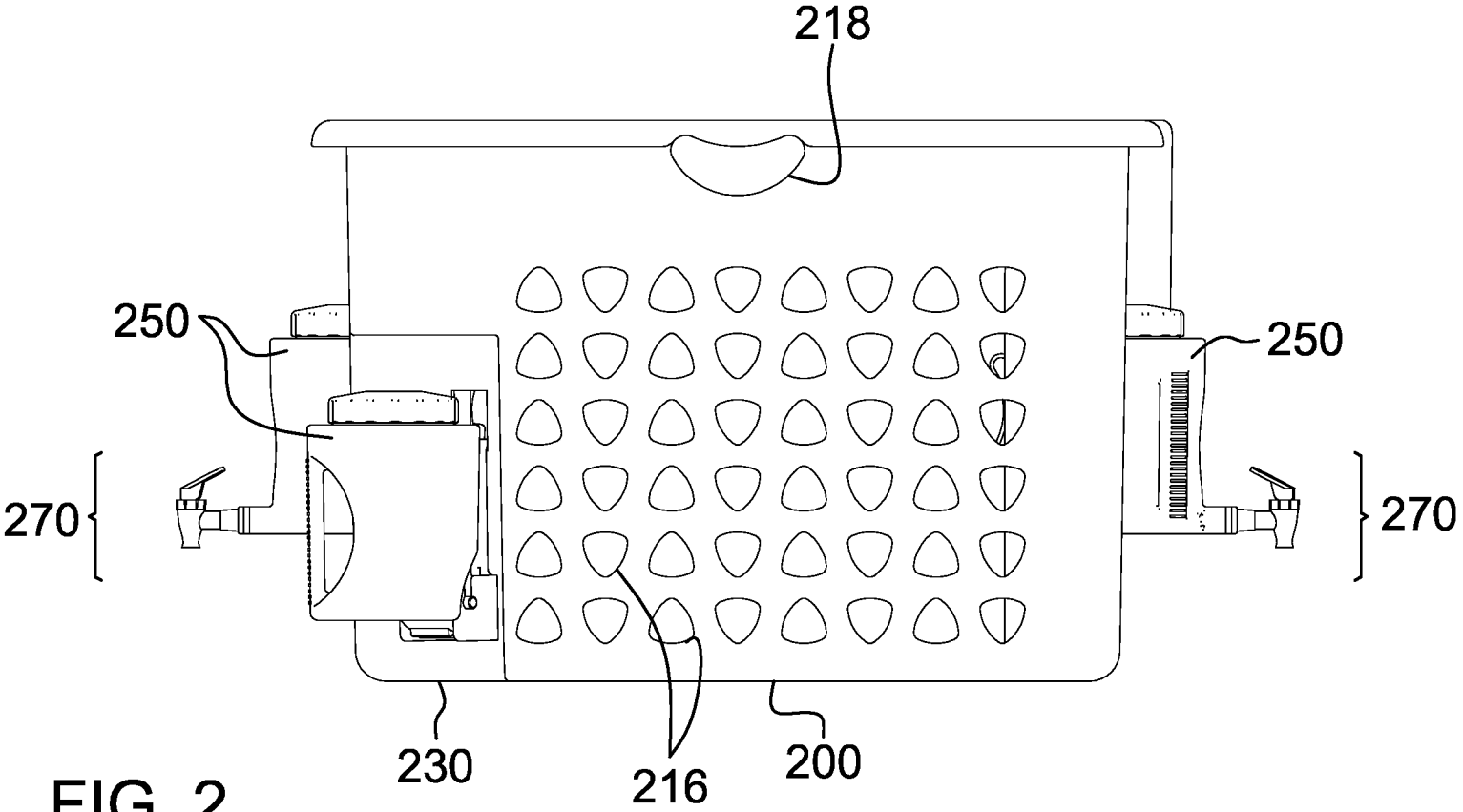
FIG. 2 is a right side view of an embodiment of the disclosure.
Figure 3:
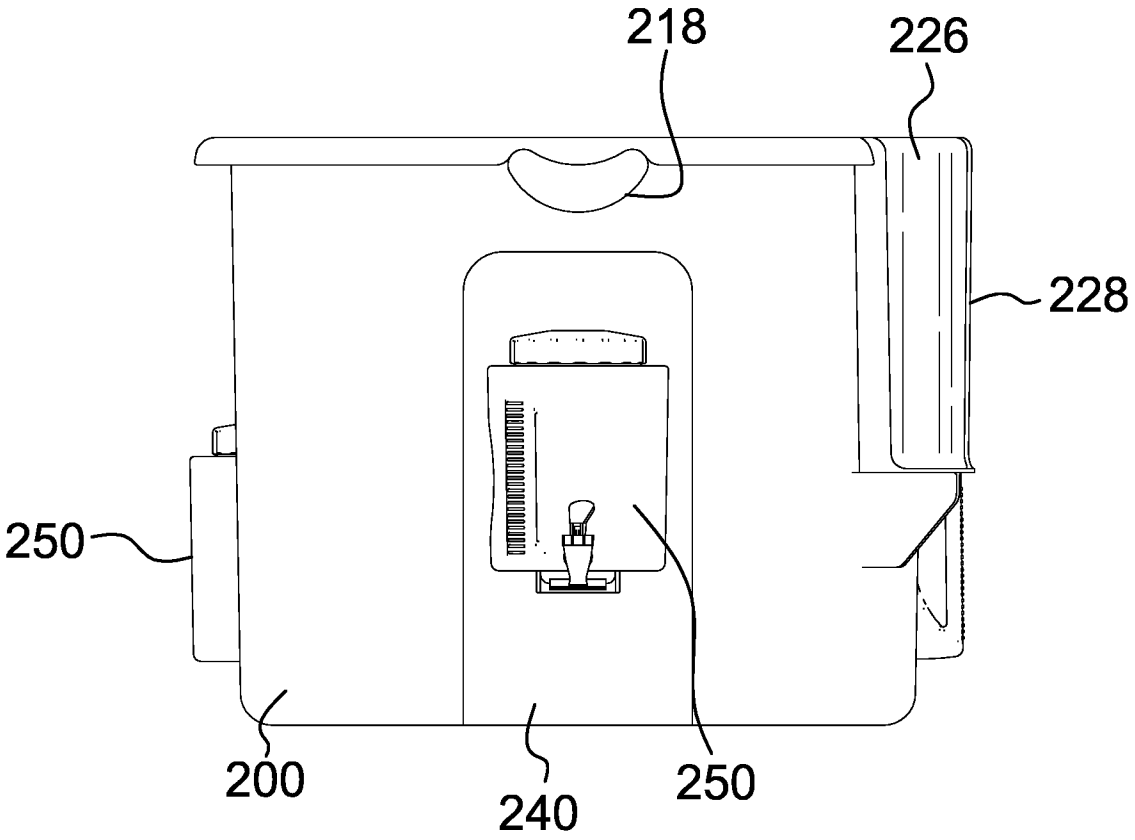
FIG. 3 is a rear view of an embodiment of the disclosure.
Figure 4:
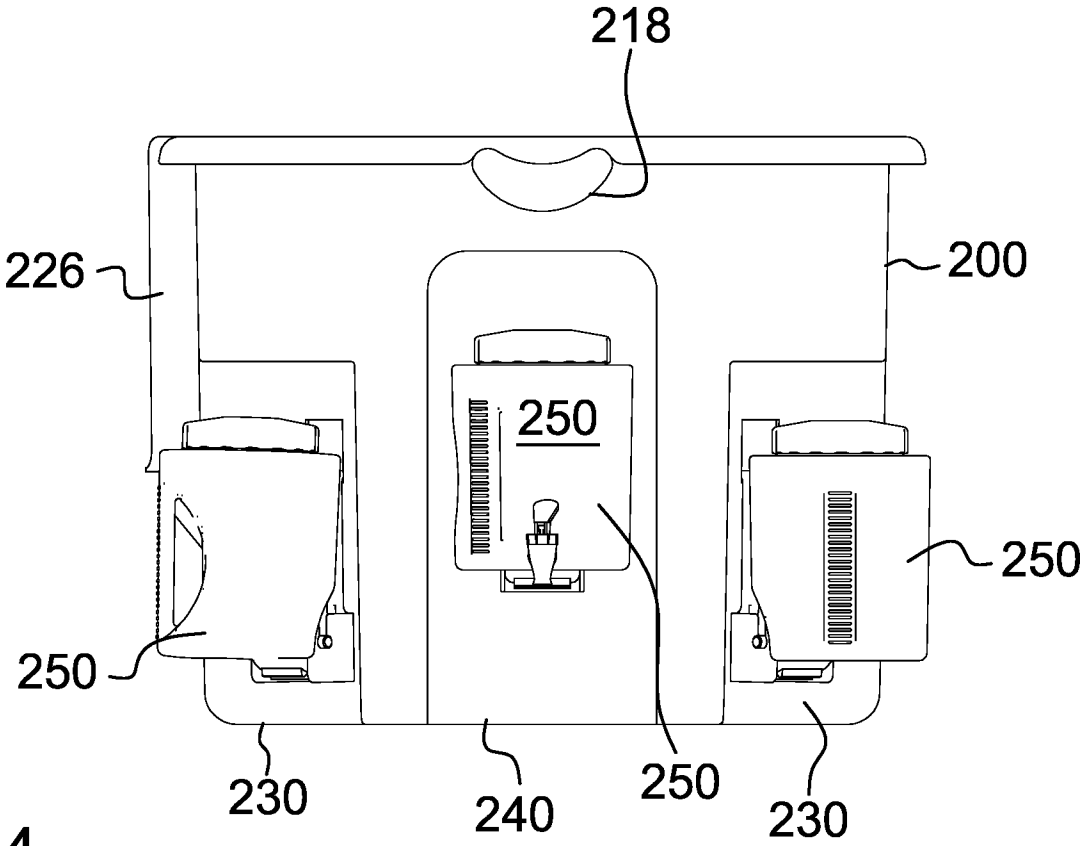
FIG. 4 is a front view of an embodiment of the disclosure.
Figure 5:
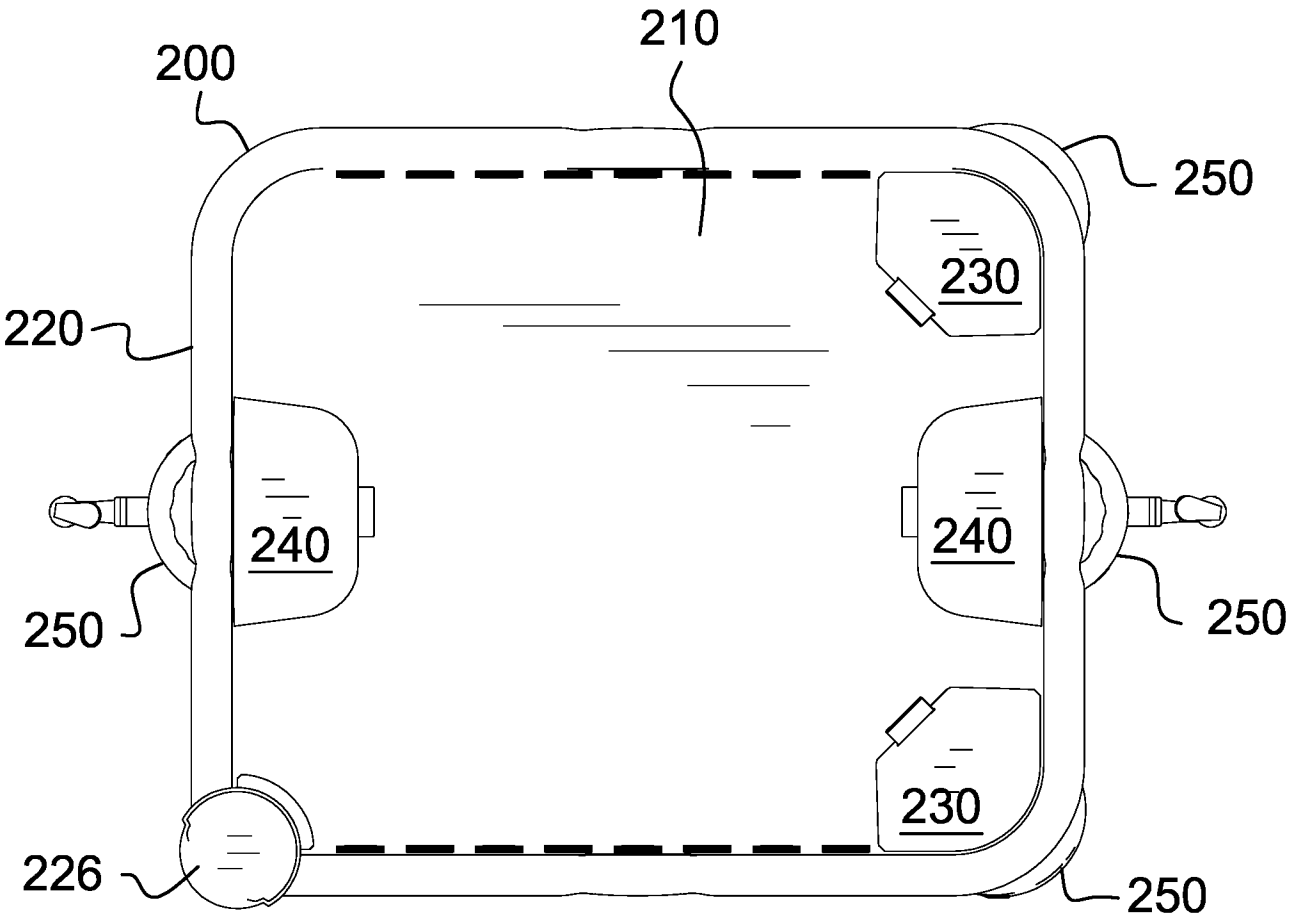
FIG. 5 is a top view of an embodiment of the disclosure.
Figure 6:
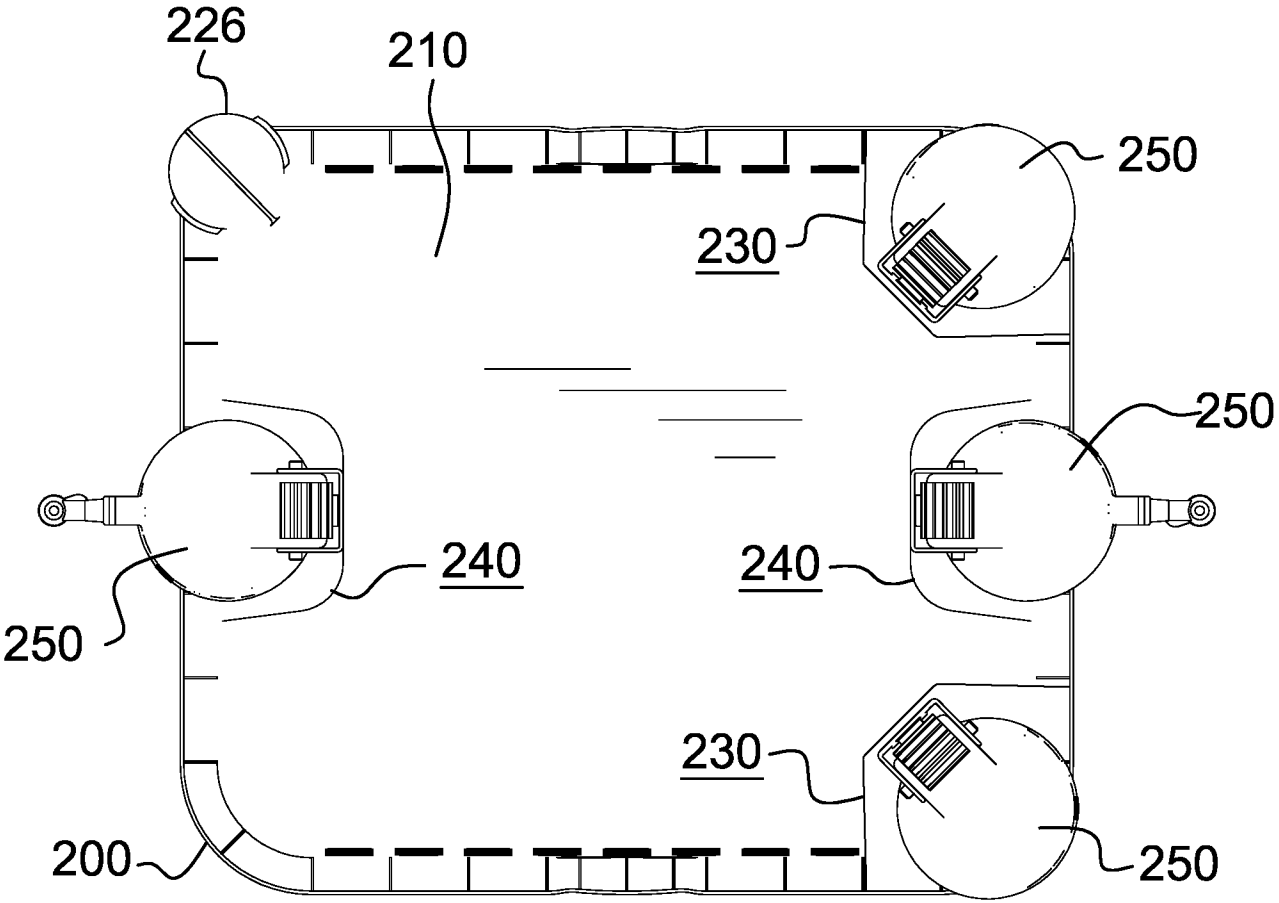
FIG. 6 is a bottom view of an embodiment of the disclosure.
Figure 7:
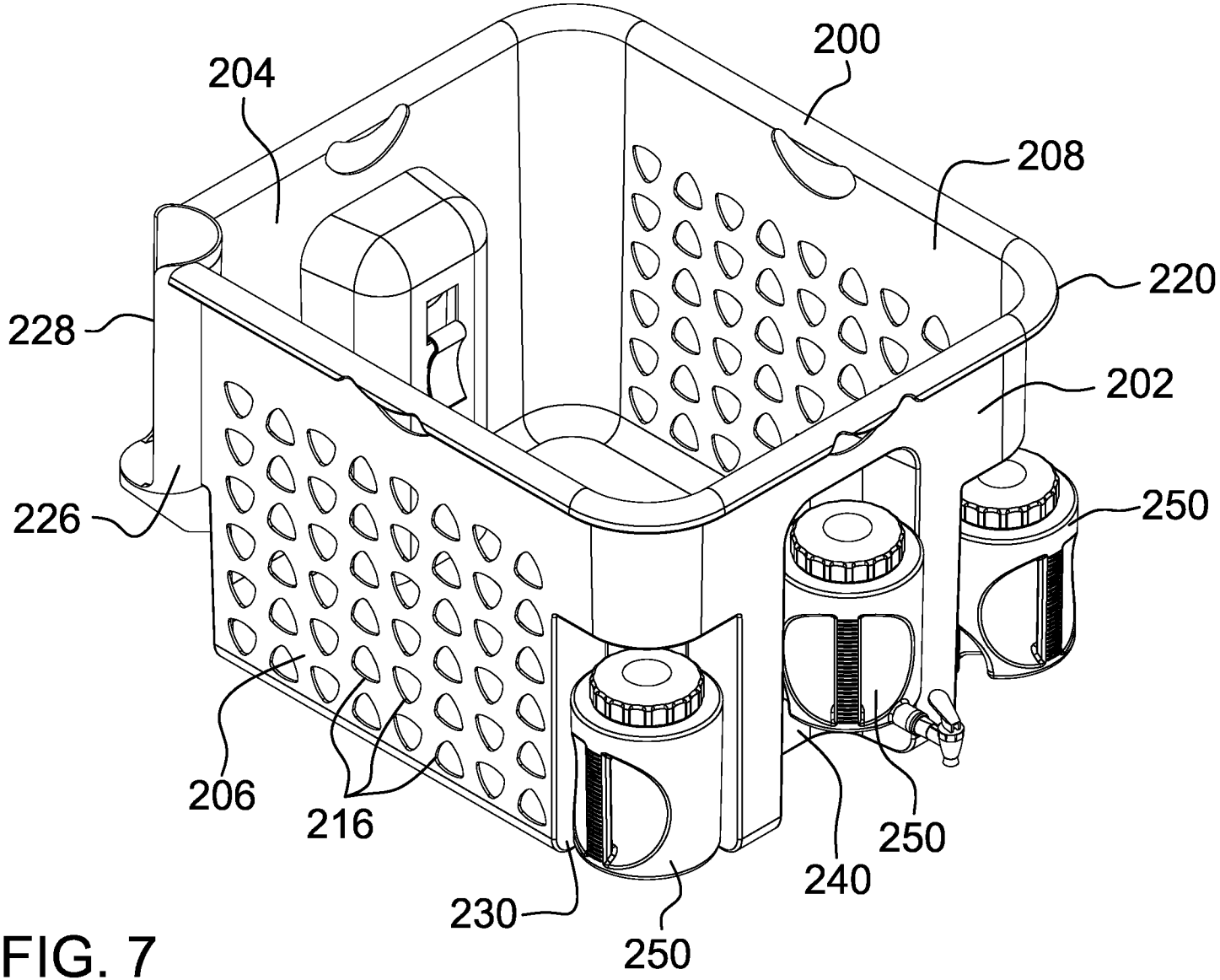
FIG. 7 is a front left isometric view of an embodiment of the disclosure.
Figure 8:
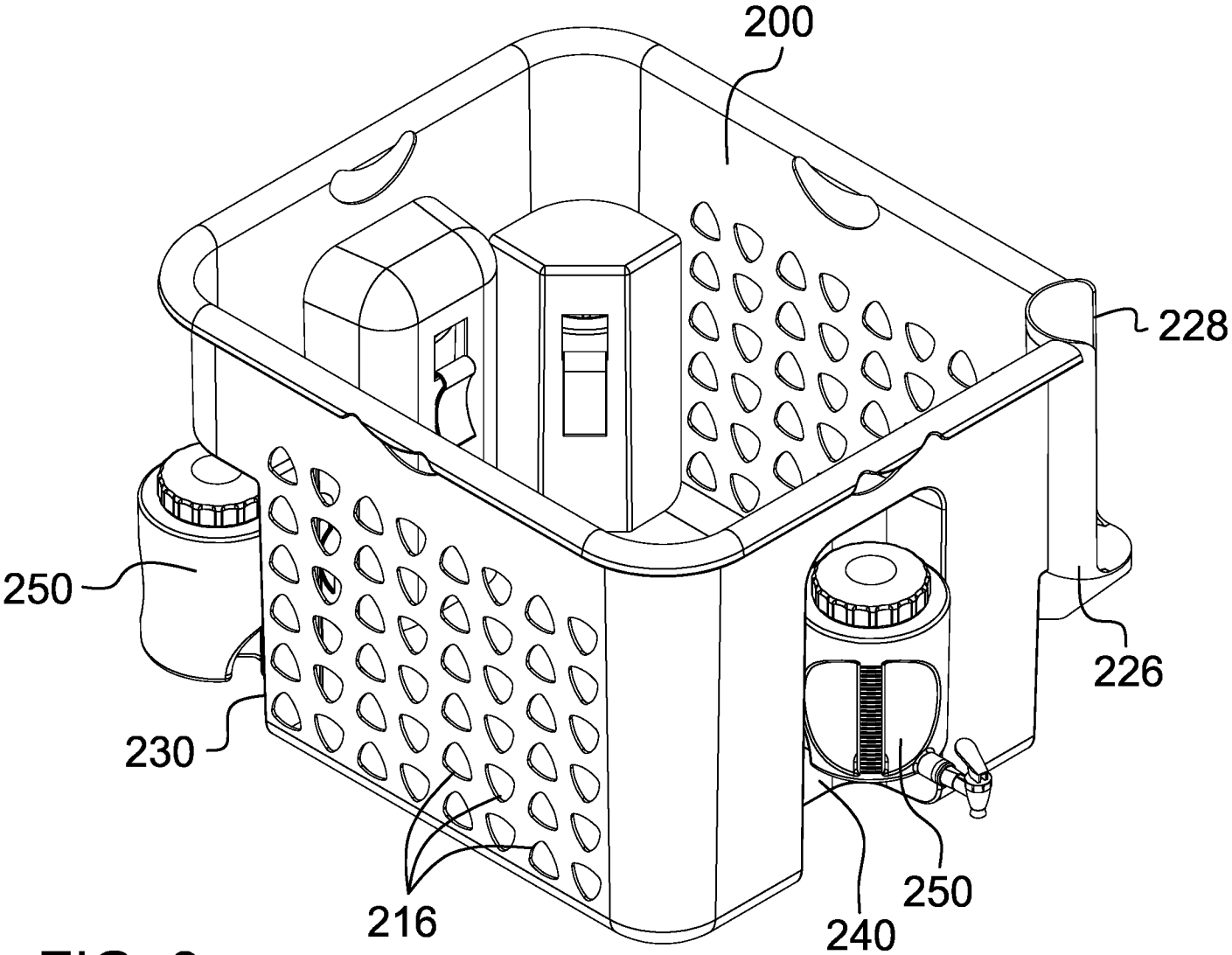
FIG. 8 is a rear right isometric view of an embodiment of the disclosure.
Figure 9:
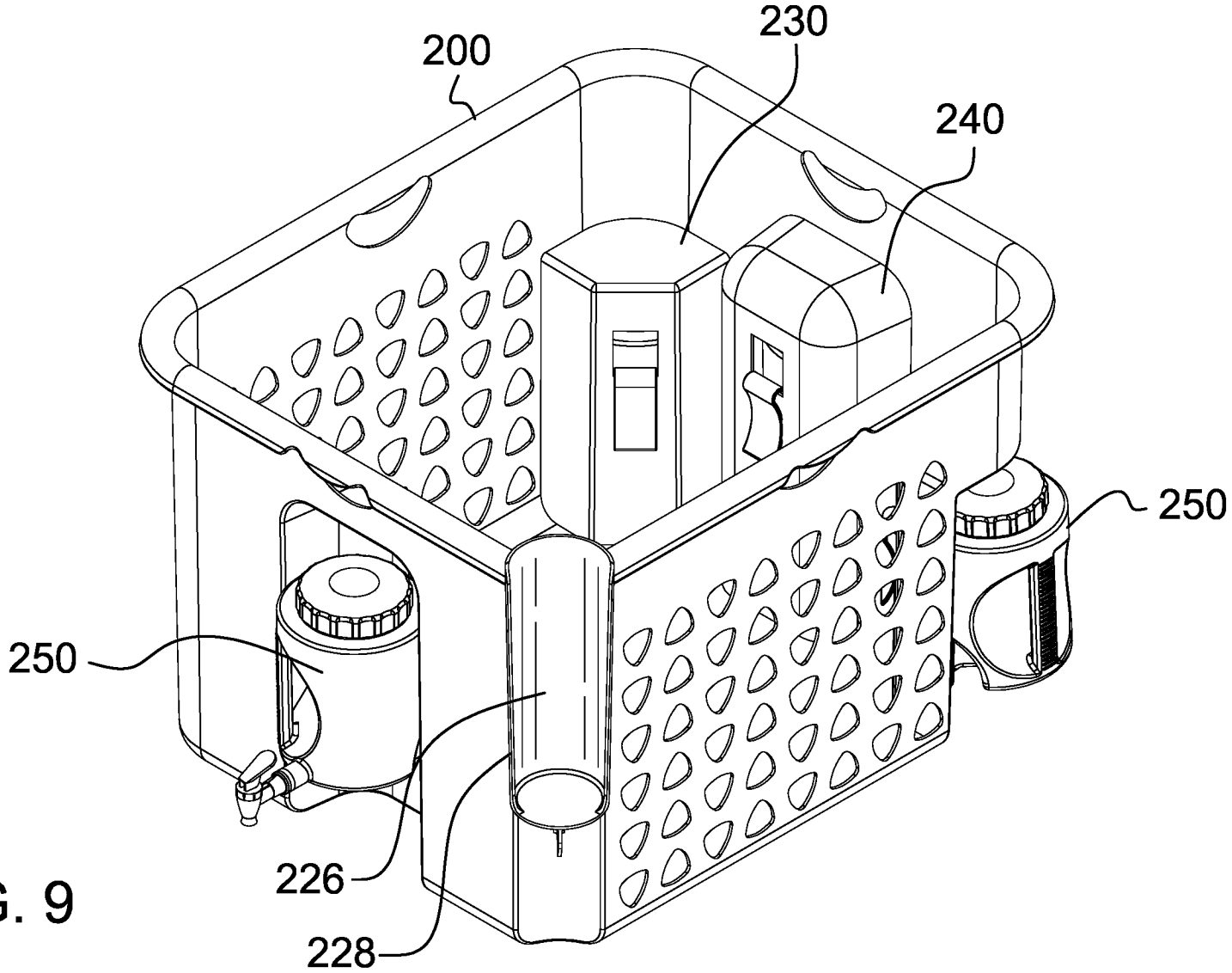
FIG. 9 is a rear left isometric view of an embodiment of the disclosure.
Figure 10:
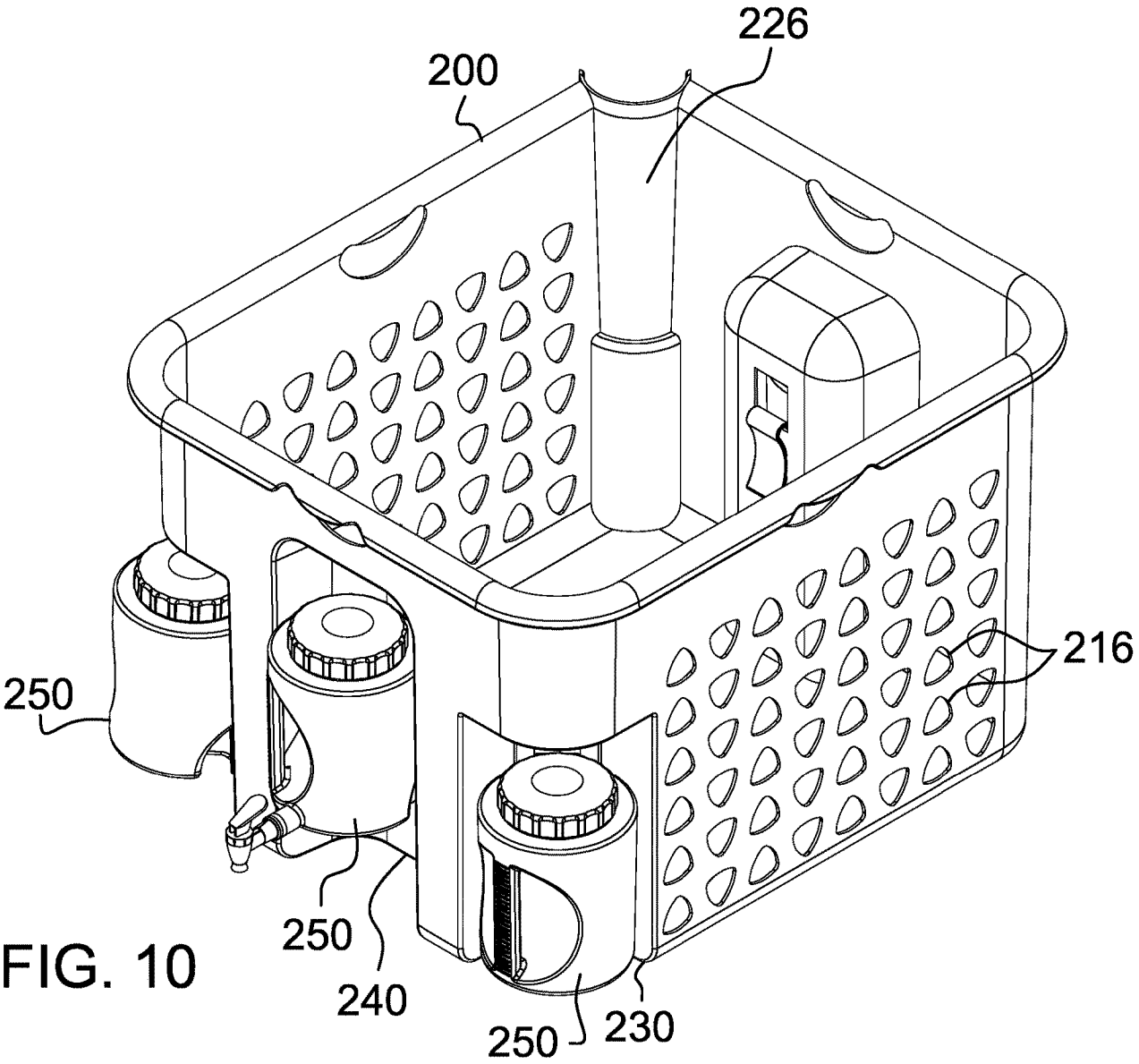
FIG. 10 is a front right isometric view of an embodiment of the disclosure.
Figure 11:
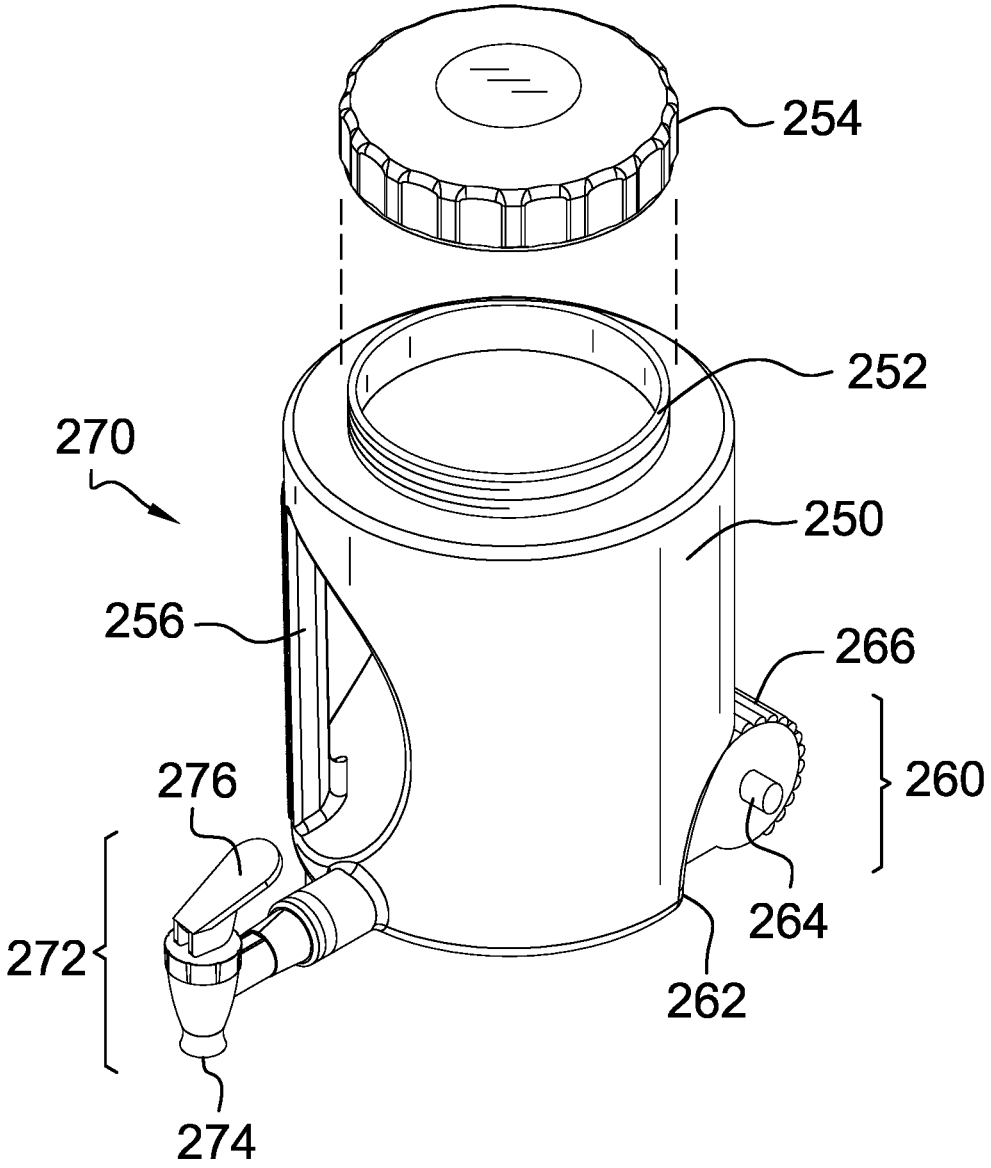
FIG. 11 is an exploded view of an embodiment of the disclosure, illustrating an individual product container.
Figure 12:
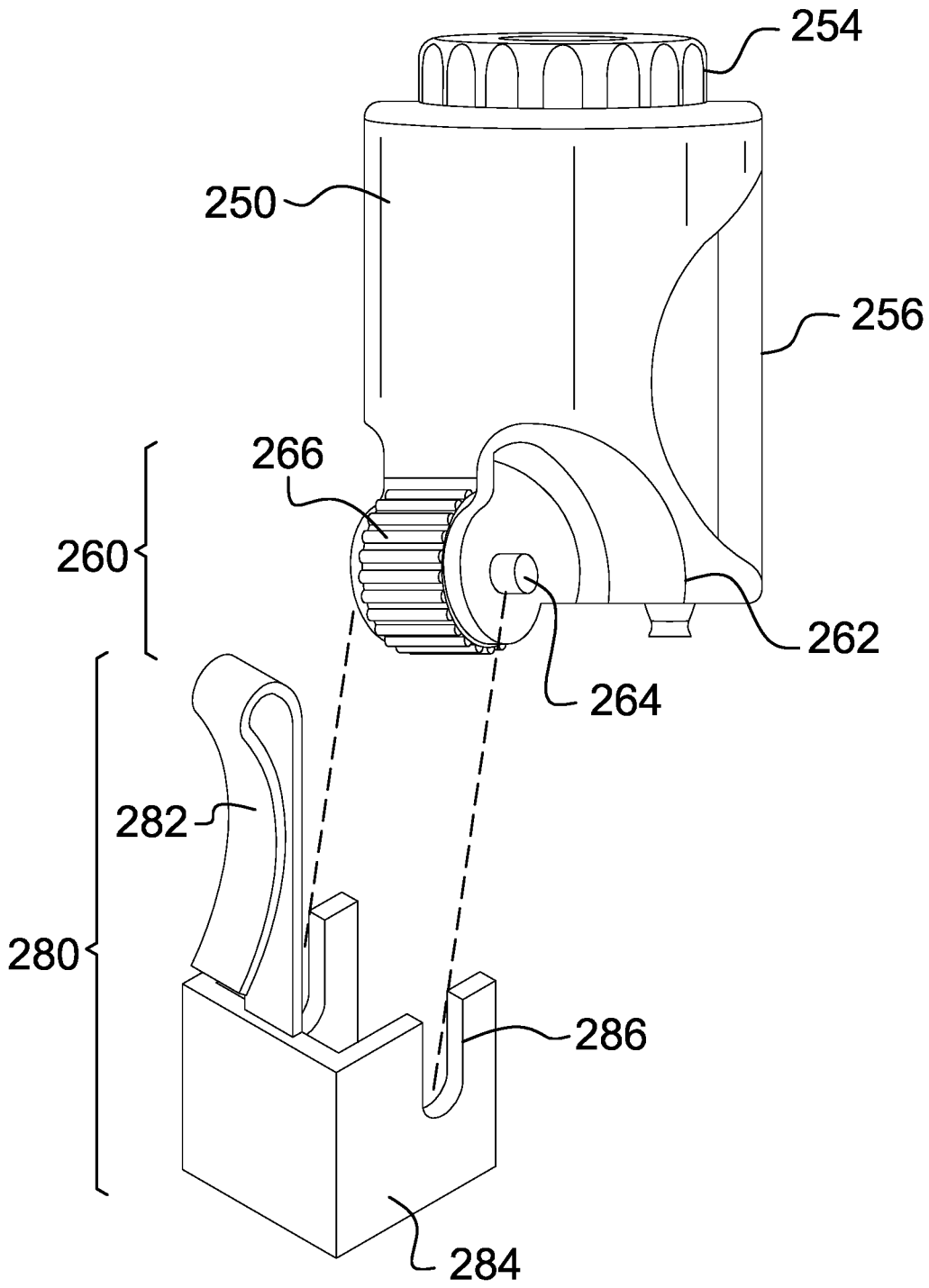
FIG. 12 is a detail view of an embodiment of the disclosure, illustrating the coupling between an individual product container and a positioning clip.
Figure 13:
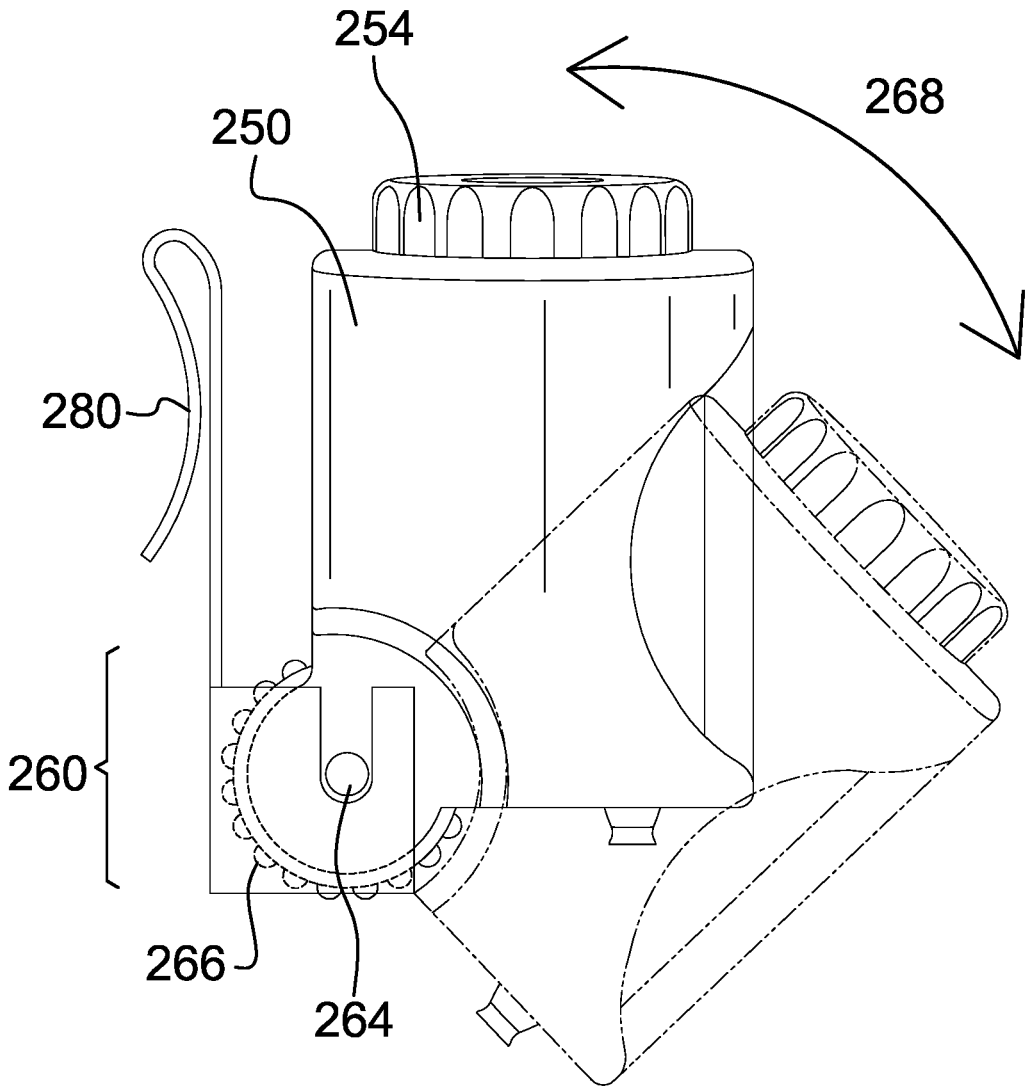
FIG. 13 is a detail view of an embodiment of the disclosure, illustrating an individual product container tilting.
Figure 14:
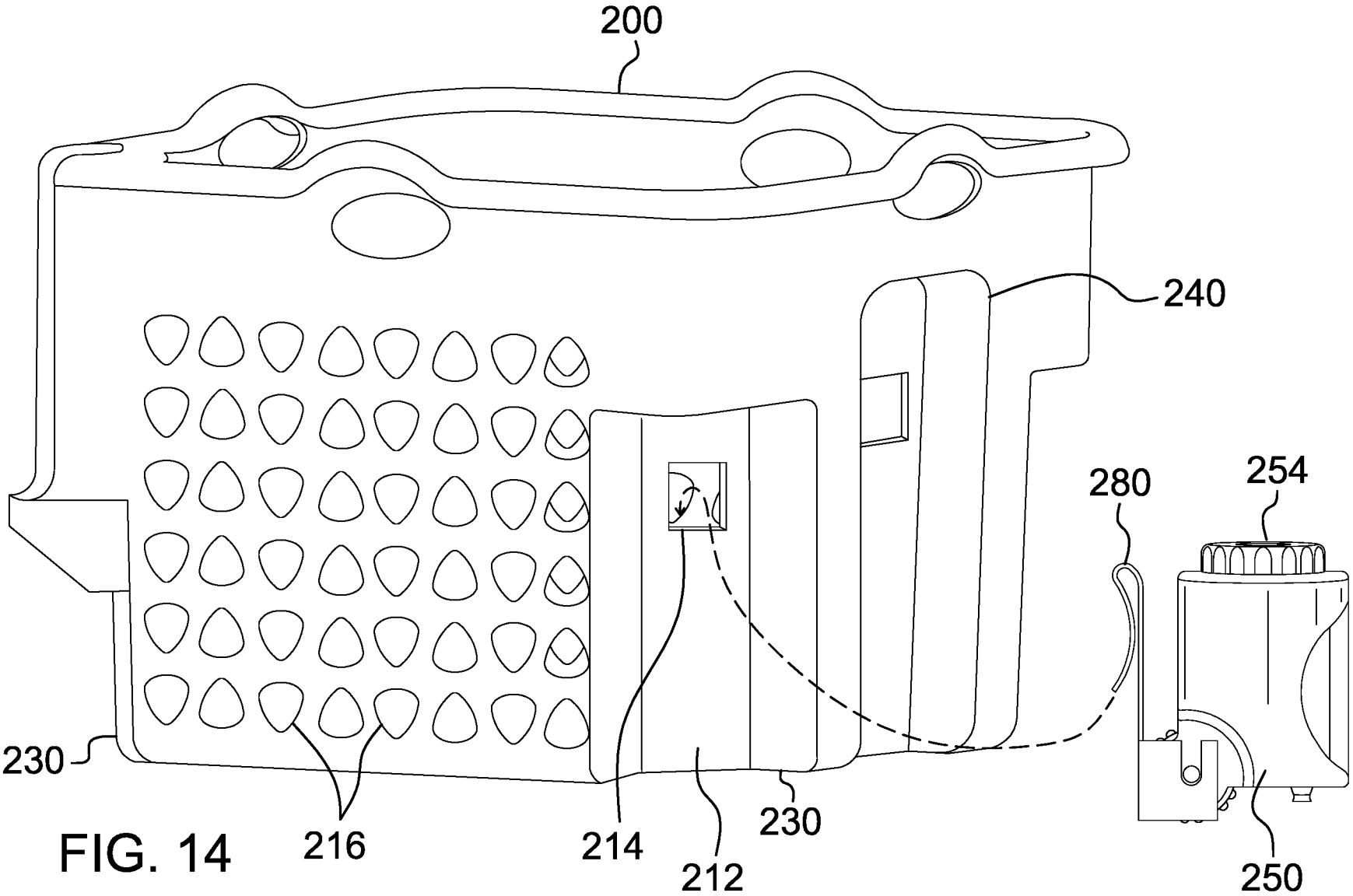
FIG. 14 is a detail view of an embodiment of the disclosure, illustrating an individual product container and positioning clip coupling to the laundry basket.

Detailed reference will now be made to a first potential embodiment of the disclosure, which is illustrated in FIGS. 1 through 14.

The improved laundry basket 100 (hereinafter invention) comprises a laundry basket 200 and a plurality of product containers 250. The laundry basket 200 may be operable to carry laundry to and/or from a laundry area. The plurality of product containers 250 may detachably couple to the laundry basket 200. Each of the plurality of product containers 250 may hold a laundry product. As non-limiting examples, the laundry product may be a liquid product, a granular product, or a powdered product. The plurality of product containers 250 may fit into a plurality of container recesses that may be exposed on the exterior of the laundry basket 200. Each of the plurality of product containers 250 may be held in place by a positioning clip 280. As non-limiting examples, the laundry products may be detergents, bleaches, fabric softeners, stain removers, and sanitizers.

The laundry basket 200 may comprise four side walls, a bottom wall 210, and the plurality of container recesses. The four side walls may comprise a front side wall 202, a rear side wall 204, a left side wall 206, and a right side wall 208. The four side walls and the bottom wall 210 may be coupled to form a hollow open-top rectangular prism operable to carry the laundry. The laundry basket 200 may comprise a brim 220 surrounding the top of the four side walls. The brim 220 may strengthen the top of the laundry basket 200. The front side wall 202 and the rear side wall 204, the left side wall 206 and the right side wall 208, or all of the four side walls may comprise basket handles 218 that may be adapted for a user to grasp while carrying the laundry basket 200. The basket handles 218 may be positioned at the top center of walls where the basket handles 218 appear. The front side wall 202, the rear side wall 204, the left side wall 206, the right side wall 208 or any combination thereof may comprise a plurality of air flow cutouts 216. The plurality of air flow cutouts 216 may enable air to circulate through the laundry.

The plurality of container recesses may be indentations in the laundry basket 200. The plurality of product containers 250 may be detachably coupled within the plurality of container recesses such that the plurality of product containers 250 may be transported with the laundry basket 200. The plurality of container recesses may extend from the bottom of the laundry basket 200 up to a height that is less than the height of the laundry basket 200. The height of the plurality of container recesses may be at least the height of the tallest of the plurality of product containers 250.

The center of each of the plurality of container recesses may comprise a flat clip surface 212 with a clip aperture 214. The positioning clips 280 may detachably couple to the clip apertures 214 and to the plurality of product containers 250 to hold the plurality of product containers 250 in place.

The plurality of container recesses may comprise one or more corner recesses 230 and one or more side recesses 240. The one or more corner recesses 230 may be located where the front side wall 202 meets the left side wall 206, where the front side wall 202 meets the right side wall 208, the rear side wall 204 meets the left side wall 206, where the rear side wall 204 meets the right side wall 208, or any combination thereof. The one or more side recesses 240 may be located at the center of the front side wall 202, the rear side wall 204, the left side wall 206, the right side wall 208, or any combination thereof.

The plurality of product containers 250 may be hollow vessels for storing the laundry products. An individual product container selected from the plurality of product containers 250 may comprise a refill aperture 252 at the top for accessing the laundry product and/or for refilling the individual product container. The refill aperture 252 may be covered by a cap 254 to prevent spills. As a non-limiting example, the cap 254 may screw onto the individual product container to cover the refill aperture 252. The individual product container may comprise a container handle 256 that may be adapted for the user to grasp while lifting the individual product container.

The individual product container may comprise a mounting interface 260 for detachably coupling the individual product container to the positioning clip 280. The mounting interface 260 may also enable the individual product container to be tilted while coupled to the laundry basket 200 and the mounting interface 260 may hold the individual product container at a tilt angle 268. As non-limiting examples, the tilt angle 268 may comprise the fully-upright, non-tilted position of the individual product container as well as any tilted position.

The mounting interface 260 may comprise a clip clearance indentation 262 which may be one or more arc-shaped indentations on the bottom of the individual product container to provide clearance for the positioning clip 280 when the individual product container is tilted. The mounting interface 260 may comprise a pair of opposing pivot arms 264 which may be rods projecting from opposite sides of the mounting interface 260. The pair of opposing pivot arms 264 may detachably mate with a pair of pivot notches 286 on the positioning clip 280. The individual product container may tilt by rotating at the pair of opposing pivot arms 264. The mounting interface 260 may comprise a positioning gear 266. The positioning gear 266 may be a series of laterally-oriented teeth encircling the pair of opposing pivot arms 264. The positioning gear 266 may make friction contact with the positioning clip 280 to hold the individual product container at the tilt angle 268. The tilt angle 268 may be changed by applying an external force to the individual product container such that the external force overcomes the friction contact and repositions the individual product container.

One or more of the individual product containers may dispense a liquid product. A liquid dispensing container 270 may comprise a spigot 272 projecting from the side of the individual product container that is opposite the mounting interface 260. The spigot 272 may comprise a spout 274 and a spigot handle 276. The liquid product may flow through the spigot 272 to the spout 274 when the spigot 272 is opened by moving the spigot handle 276 to the open position. The liquid product may cease flowing through the spigot 272 when the spigot 272 is closed by moving the spigot handle 276 to the closed position. In some embodiments, the liquid dispensing container 270 may be coupled to the laundry basket 200 at an elevated position such that space exists between the bottom of the spout 274 and the surface that the laundry basket 200 rests upon. As a non-limiting example, the space between the bottom of the spout 274 and the surface that the laundry basket 200 rests upon may permit a laundry detergent cup to be positioned beneath the spout 274 to capture the liquid product as the liquid product is dispensed.

The granular products and the powdered products may be dispensed from the plurality of product containers 250 by removing the cap 254 and either pouring or scooping the laundry product from the plurality of product containers 250.

The laundry basket 200 may comprise a bleach container holder 226 into which a bleach container may be placed. The bleach container holder 226 may comprise an open-top hollow cylindrical cavity located at one upper corner of the laundry basket 200. The bleach container holder 226 may comprise a bleach container notch 228. The bleach container notch 228 may permit the bleach container holder 226 to flex when inserting or removing the bleach container and may provide visibility of the bleach container for the purpose of determining how much content remains in the bleach container.

The positioning clip 280 may comprise a hanger 282 that may hang on the laundry basket 200 at one of the clip apertures 214 and a container interface 284 which may detachably couple to the mounting interface 260 of the individual product container. The hanger 282 may be an inverted U-shaped armature. The container interface 284 may be coupled to the bottom of the hanger 282 and may comprise the pair of pivot notches 286 into which the pair of opposing pivot arms 264 may be inserted.

In use, laundry may be placed into the laundry basket 200 to carry the laundry to or from a laundry area. Laundry products, including but not limited to detergents, bleaches, fabric softeners, stain removers, and sanitizers, may be placed into the plurality of product containers 250 that detachably couple to the laundry basket 200. The laundry products may be dispensed from the plurality of product containers 250 with or without removing the plurality of product containers 250 from the laundry basket 200. As non-limiting examples, the laundry product may be scooped from the refill aperture 252 of an individual product container after removing the cap 254, may be poured from the individual product container, or may be dispensed from the spigot 272 either into the laundry detergent cup or directly into a washing machine. If desired, the plurality of product containers 250 may be tilted while coupled to the laundry basket 200 for easier access.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, a "cavity" may be an empty space or negative space that is formed within an object.

As used herein, "clip" may refer to a fastener that attaches to an object by gripping or clasping the object. A clip may be spring loaded.

As used herein, the words "couple", "couples", "coupled" or "coupling", may refer to connecting, either directly or indirectly, and does not necessarily imply a mechanical connection.

As used in this disclosure, the word "exterior" may be used as a relational term that implies that an object is not located or contained within the boundary of a structure or a space.

As used herein, "filling", or "refilling", refers to the act of placing a first item into a second item whether the quantity of the first item fills the second item or not. As non-limiting examples, the first item may be a liquid, such as water, oil, or gasoline, or a granulated solid, such as sand or coffee beans. As non-limiting examples, the second item may be a bin, a bottle, a tank, or another type of container.

As used herein, "handle" may refer to an object by which a tool, object, or door is held or manipulated with the hand.

As used herein, the words "invert", "inverted", or "inversion" may refer to an object that has been turned inside out or upside down or to the act of turning an object inside out or upside down.

As used in this disclosure, the word "lateral" may refer to the sides of an object or movement towards a side. Lateral directions are generally perpendicular to longitudinal directions. "Laterally" may refer to movement in a lateral direction.

As used herein, "laundry area" may refer to any room or area where a washing machine, dryer, or both are located.

As used herein, "mate" may refer to a retaining, coupling, connecting, interlocking, or interfacing at a predefined interface.

As used in this disclosure, a "notch" may be an indentation formed in an edge or a cavity or aperture formed within a surface.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

With respect to the above description, it is to be realized that the optimum dimensional relationship for the various components of the invention described above and in FIGS. 1 through 14, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An improved laundry basket comprising:

a laundry basket and a plurality of product containers;

wherein the laundry basket is operable to carry laundry to and/or from a laundry area;

wherein the plurality of product containers detachably couple to the laundry basket;

wherein each of the plurality of product containers hold a laundry product;

wherein the plurality of product containers fit into a plurality of container recesses that are exposed on the exterior of the laundry basket;

wherein each of the plurality of product containers are held in place by a positioning clip;

wherein the laundry basket comprises four side walls, a bottom wall, and the plurality of container recesses;

wherein the laundry basket comprises a brim surrounding the top of the four side walls;

wherein the plurality of container recesses extend from the bottom wall of the laundry basket up to a height that is less than the laundry basket.

2. The improved laundry basket according to claim 1 wherein the four side walls and the bottom wall are coupled to form a hollow open-top rectangular prism operable to carry the laundry.

3. The improved laundry basket according to claim 2 wherein the brim strengthens the top of the laundry basket.

4. The improved laundry basket according to claim 3 wherein a front side wall and a rear side wall, a left side wall and a right side wall, or all of the four side walls comprise basket handles that are adapted for a user to grasp while carrying the laundry basket;

wherein the basket handles are positioned at the top center of walls where the basket handles appear.

5. The improved laundry basket according to claim 4 wherein the front side wall, the rear side wall, the left side wall, the right side wall or any combination thereof comprise a plurality of air flow cutouts;

wherein the plurality of air flow cutouts enable air to circulate through the laundry.

6. The improved laundry basket according to claim 5 wherein the plurality of container recesses are indentations in the laundry basket;

wherein the plurality of product containers are detachably coupled within the plurality of container recesses such that the plurality of product containers are transported with the laundry basket.

7. The improved laundry basket according to claim 6 wherein the height of the plurality of container recesses is at least the height of the tallest of the plurality of product containers.

8. The improved laundry basket according to claim 7 wherein the center of each of the plurality of container recesses comprise a flat clip surface with a clip aperture;

wherein the positioning clips detachably couple to the clip apertures and to the plurality of product containers to hold the plurality of product containers in place.

9. The improved laundry basket according to claim 8 wherein the plurality of container recesses comprise one or more corner recesses and one or more side recesses;

wherein the one or more corner recesses are located where the front side wall meets the left side wall, where the front side wall meets the right side wall, the rear side wall meets the left side wall, where the rear side wall meets the right side wall, or any combination thereof.

10. The improved laundry basket according to claim 9 wherein the one or more side recesses are located at the center of the front side wall, the rear side wall, the left side wall, the right side wall, or any combination thereof.

11. The improved laundry basket according to claim 10 wherein the plurality of product containers are hollow vessels for storing the laundry products;

wherein an individual product container selected from the plurality of product containers comprises a refill aperture at the top for accessing the laundry product and/or for refilling the individual product container;

wherein the refill aperture is covered by a cap to prevent spills.

12. The improved laundry basket according to claim 11 wherein the cap screws onto the individual product container to cover the refill aperture.

13. The improved laundry basket according to claim 11 wherein the individual product container comprises a container handle that is adapted for the user to grasp while lifting the individual product container.

14. The improved laundry basket according to claim 13 wherein the individual product container comprises a mounting interface for detachably coupling the individual product container to the positioning clip;

wherein the mounting interface also enables the individual product container to be tilted while coupled to the laundry basket;

wherein the mounting interface holds the individual product container at a tilt angle.

15. The improved laundry basket according to claim 14 wherein the mounting interface comprises a clip clearance indentation which is one or more arc-shaped indentations on the bottom of the individual product container to provide clearance for the positioning clip when the individual product container is tilted;

wherein the mounting interface comprises a pair of opposing pivot arms which are rods projecting from opposite sides of the mounting interface;

wherein the pair of opposing pivot arms detachably mate with a pair of pivot notches on the positioning clip;

wherein the individual product container tilts by rotating at the pair of opposing pivot arms;

wherein the mounting interface comprises a positioning gear;

wherein the positioning gear is a series of laterally-oriented teeth encircling the pair of opposing pivot arms;

wherein the positioning gear makes friction contact with the positioning clip to hold the individual product container at the tilt angle;

wherein the tilt angle is changed by applying an external force to the individual product container such that the external force overcomes the friction contact and repositions the individual product container.

16. The improved laundry basket according to claim 15 wherein one or more of the individual product containers dispense a liquid product;

wherein a liquid dispensing container comprises a spigot projecting from the side of the individual product container that is opposite the mounting interface;

wherein the spigot comprises a spout and a spigot handle;

wherein the liquid product flows through the spigot to the spout when the spigot is opened by moving the spigot handle to the open position;

wherein the liquid product ceases flowing through the spigot when the spigot is closed by moving the spigot handle to the closed position.

17. The improved laundry basket according to claim 16 wherein granular products and powdered products are dispensed from the plurality of product containers by removing the cap and either pouring or scooping the laundry product from the plurality of product containers.

18. The improved laundry basket according to claim 17 wherein the laundry basket comprises a bleach container holder into which a bleach container is placed;

wherein the bleach container holder comprises an open-top hollow cylindrical cavity located at one upper corner of the laundry basket;

wherein the bleach container holder comprises a bleach container notch;

wherein the bleach container notch permits the bleach container holder to flex when inserting or removing the bleach container and provides visibility of the bleach container.

19. The improved laundry basket according to claim 18 wherein the positioning clip comprises a hanger that hangs on the laundry basket at one of the clip apertures and a container interface which detachably couples to the mounting interface of the individual product container;

wherein the hanger is an inverted U-shaped armature;

wherein the container interface is coupled to the bottom of the hanger and comprises the pair of pivot notches into which the pair of opposing pivot arms are inserted.

* * * * *